United States Patent [19]

Murphy et al.

[11] 3,962,100

[45] June 8, 1976

[54] FABRIC SOFTENING AGENTS

[75] Inventors: Alan P. Murphy; Rickey Kretschmar, both of Cincinnati, Ohio

[73] Assignee: The Procter & Gamble Company, Cincinnati, Ohio

[22] Filed: Aug. 18, 1975

[21] Appl. No.: 605,479

[52] U.S. Cl. ..... 252/8.8; 252/8.6; 252/8.7; 252/8.75; 252/8.9; 260/501.11; 260/534 R; 428/264; 428/219

[51] Int. Cl.[2] ..... D06M 13/36

[58] Field of Search ..... 260/501.11, 534 R; 252/8.6, 8.7, 8.75, 8.8, 8.9; 428/264

[56] References Cited

UNITED STATES PATENTS

| | | | |
|---|---|---|---|
| 2,477,383 | 7/1949 | Lewis | 252/161 |
| 3,159,581 | 12/1964 | Diehl | 252/152 |
| 3,213,030 | 10/1965 | Diehl | 252/152 |
| 3,308,067 | 4/1963 | Diehl | 252/550 |
| 3,400,148 | 9/1968 | Quimby | 260/932 |
| 3,400,176 | 9/1968 | Quimby | 260/932 |
| 3,414,459 | 12/1968 | Wells | 161/131 |
| 3,422,021 | 1/1969 | Roy | 252/161 |
| 3,422,137 | 1/1969 | Quimby | 260/502.4 |
| 3,465,036 | 9/1969 | Dundon | 260/511.11 |
| 3,553,254 | 1/1971 | Tesoro et al. | 252/8.8 X |
| 3,686,025 | 8/1972 | Morton | 428,252/219;8.8 X |
| 3,795,611 | 3/1974 | Wixon | 252/8.8 X |
| 3,844,959 | 10/1974 | Cracco et al. | 252/8.8 X |
| 3,862,058 | 1/1975 | Nirschl et al. | 252/8.8 X |

OTHER PUBLICATIONS

P. Bornemann, Journal Fur Praktische Chemie, 4th series, vol. 9, p. 217, (1958).

Chem. Abs. 69:97651y; 73:88907s.

*Primary Examiner*—Murray Tillman
*Assistant Examiner*—T. De Benedictis
*Attorney, Agent, or Firm*—Jerry J. Yetter; Julius P. Filcik; Richard C. Witte

[57] ABSTRACT

Alkyl ammonium cabamates are fabric softeners and anti-stats which can be used in pre-soaks and dryer-added products, and in combination with laundry detergents as through-the-wash fabric softeners.

22 Claims, No Drawings

FABRIC SOFTENING AGENTS

BACKGROUND OF THE INVENTION

The present invention relates to articles and compositions for imparting softening and anti-static benefits to fabrics in a laundry process. More particularly, alkyl ammonium carbamates applied to fabrics under typical home-use conditions provide excellent softness and static control.

It has long been recognized that certain chemical compounds have the capability of imparting softness to textile fabrics. These compounds, which are known generally as "softening agents," "fabric softeners," or "softeners," have been used by the textule industry and by home and industrial laundry processors to soften finished fabrics, thereby making them smooth, pliable and fluffy to handle. In addition to the quality of softness, the fabrics have a reduced tendency to static cling and are easier to iron.

Most commercial fabric softeners are optimally used in detergent-free rinse bath. However, such use requires a separate laundering step, i.e., separate addition of the softener during the rinse cycle. Accordingly, there has been a continuing search for through-the-wash fabric softeners.

The softening agents which are usually employed in commercial fabric softener compositions are cationic surfactant compounds, commonly quaternary ammonium compounds having at least two long alkyl chains. The positive charge on the softening compound encourages its deposition onto the fabric substrate, the surface of which is usually negatively charged. Unfortunately, the cationic softeners for a scumlike, non-softening complex with common anionic detergents. With nonionic detergents, too much of the softener is removed during the washing and rinsing cycles and the little remaining on the fabrics has no substantial softening effect.

The present invention avoids the use of cationic softeners except as optional adjunct softeners. Rather, alkyl ammonium carbamate salts are employed as softeners. These carbamate salts do not readily dissociate in water and do not undesirably react with the common anionic detersive surfactants found in most commercial laundering compositions.

Softening agents are usually employed in liquid compositions, but powder, tablet and granular formulations are also known. In recent years it has become increasingly common to impregnate water-insoluble cloth or paper substrates with softening compositions. The substrate can then be added directly to an automatic dryer. During the course of the drying operation the active softening material is transferred to the fabrics being dried. The carbamate salts herein can be used in any of these forms to condition fabrics.

It is an object of the present invention to provide softening compositions and articles which are capable of imparting superior softness and anti-static properties to fabrics.

It is another object of this invention to provide softeners which can be added at the first step of the laundry process, i.e., in the laundry pre-soak bath or in the wash cycle, in the presence of an anionic surfactant.

It is another object of this invention to provide articles which can be added to a clothes dryer to impart improved softening and anti-static benefits to fabrics.

These and other objects are achieved by means of the alkyl ammonium carbamates disclosed herein.

SUMMARY OF THE INVENTION

The present invention is based on the discovery that alkyl ammonium carbamates of the general formula $$R_1R_2\overset{+}{N}H_2\ \overset{-}{O}\ (O)CNR_3R_4$$

wherein $R_1$ is hydrogen or an alkyl group, e.g. those from 1 to 22 carbon atoms; $R_2$ is a long chain alkyl group having 10 or more carbon atoms, preferably from about 10 to about 22 carbon atoms; $R_3$ is hydrogen or an alkyl group, e.g. those from 1 to about 22 carbon atoms; and $R_4$ is hydrogen or an alkyl group, e.g. those from 1 to about 22 carbon atoms, can be used to impart excellent softness and anti-static benefits to fabrics.

The alkyl ammonium carbamates of the present type are compartible with anionic detergents. Accordingly, fully-formulated, built and un-built, combined detergent/softeners can be prepared using these compounds.

Preferred washer-added softener compositions herein contain a clay which suspends the carbamate in the aqueous laundry bath. Such compositions can be, for example, liquids containing the alkyl ammonium carbamate, clay, a lower alkyl alcohol, and water.

Combined detergent/softener compositions herein contain an alkyl ammonium carbamate and a cationic or anionic detersive surfactant and, preferably, a clay or other suspending agent for the carbamate. A similar detergent or pre-soak composition contains alkyl ammonium carbamates, enzymes, cationic, anionic, or nonionic detersive surfactants and mixtures thereof, and, optionally, detergency builders.

The invention also encompasses articles and methods for softening and imparting an anti-static finish to fabrics in an automatic dryer comprising commingling pieces of damp fabric with an effective, i.e., softening, amount of alkyl ammonium carbamate which is preferably in releasable combination with a dispensing means.

The compositions, articles and processes herein are described in great detail, hereinafter. All of the percentages are by weight unless specifically designated.

DETAILED DESCRIPTION OF THE INVENTION

The combined fabric softening and anti-static active agent employed in the present compositions, articles and processes comprises alkyl-substituted ammonium carbamate materials of the general formula set forth hereinabove. (The term "alkyl" as employed herein includes saturated and unsaturated, substituted and unsubstituted, linear and cyclic, hydrocarbyl moieties.)

The alkylammonium carbamates must have one long chain alkyl substituent to impart the softness and anti-static properties to the fabrics. Non-limiting examples of suitable long-chain alkyl substituents, i.e., $R_2$ groups, are: decyl, dodecyl, tetradecyl, hexadecyl, octadecyl, eicosyl, docosyl, oleyl, linoleyl, linolenyl, and eleostearyl.

The other alkyl substituents, $R_1$, $R_3$ and $R_4$, can be independently hydrogen, or an alkyl group. Non-limiting examples of suitable alkyl groups are methyl, ethyl, propyl, isopropyl, butyl, hexyl, octyl, decyl, cyclohexyl and cyclopentyl. In addition, the alkyl groups $R_1$, $R_3$ and $R_4$ can be the same as the long chain alkyl group, $R_2$. 30 Because of the method by which the carbamate compounds are most easily perpared, the preferred alkyl ammonium carbamates are those in which $R_1$ and $R_3$ and $R_2$ and $R_4$ are the same. Thus, the molecule is symmetrically substituted. The preparation of the carbamate compounds from primary amines wherein $R_1$ and $R_3$ are hydrogen and $R_2$ and $R_4$ are the same alkyl groups, is described in an article by V. E. Leibnitz, W. Hager, S. Gipp and P. Bornemann, Journal Fur Praktsche Chemie, 4th Series, Vol. 9, 217 (1959), which is incorporated herein by reference. A similar procedure is used to prepare alkyl ammonium carbamates from secondary alkyl amines.

For example, N,N'-dioctadecyl ammonium carbamate can be prepared by dissolving the purified octadecylamine in isopropyl alcohol and bubbling carbon dioxide through the solution. The N,N'-dioctadecyl ammonium carbamate that is produced is a white solid which is preferred for use herein.

The alkyl ammonium carbamate can also be prepared by grinding or mixing the primary or secondary amine with solid carbon dioxide or dry ice.

Non-limiting examples of amines which can be used in the above manner to prepare carbamate softeners include: decylamine, undecylamine, dodecylamine, tridecylamine, tetradecylamine, pentadecylamine, hexadecylamine, heptadecylamine, octadecylamine, nonadecylamine, eicosylamine, heneicosylamine, and docosylamine.

Suitable secondary amines which can be used to prepare similar dialkyl ammonium carbamates are: didecylamine, didodecylamine, decyltetradecylamine, decylhexadecylamine, dioctadecylamine, decyloctadecylamine, dieicosylamine, decyleicosylamine, didocosylamine, methyldecylamine, ethyldecylamine, methyldodecylamine, ethyldodecylamine, methyltetradecylamine, ethyltetradecylamine, methylhexadecylamine, ethylhexadecylamine, methyloctadecylamine, ethyloctadecylamine, methyleicosylamine, and ethyleicosylamine.

Mixtures of the alkyl ammonium carbamates can be used herein. Accordingly, mixtures of amines, especially commercial tallowalkyl amines and coconutalkyl amines, can be reacted to $CO_2$ in like manner to produce inexpensive carbamate mixtures suitable for use as softeners.

It will be recognized that the alkylammonium carbamates prepared by these processes may contain some unreacted amine. On standing, the alkylammonium carbamate may lose some carbon dioxide, producing the starting amines. The presence or absence of amine impurities is of no import.

Compositions containing both the alkyl ammonium carbamate and a suspending agent, especially a clay as hereinafter defined, are a preferred embodiment of this invention. The clay acts as a suspending agent for the alkyl ammonium carbamate, and, in addition, imparts some additional softness to the fabrics. The proportion of alkyl ammonium carbamate to clay can vary widely, but clay:carbamate ratios from 1:10 to 10:1, preferably 1:4 to 4:1, by weight, are most often used.

In addition to the clays, those kinds of additives disclosed below which act as suspending agents for solids can be used in these fabric softening compositions. Non-limiting examples of suspending agents which are useful are alkyl alcohols, water-soluble solvents for the alkyl ammonium carbamates, anionic surfactants, nonionic surfactants, zwitterionic surfactants, soaps, quaternary ammonium compounds, ditallow-dimethylammonium chloride (DTDMAC), and urea clathrates thereof, and water-soluble electrolyte salts such as sodium sulfate, sodium carbonate, and sodium bicarbonate. Any soil suspending agent recognized in the detergency arts, such as cellulose derivatives, alkoxycellulose derivatives, dextrins, alginates, etc. can be used for suspending the alkylammonium carbamate in the pre-soak, wash, or rinse baths. Such agents are used in the manner and at the ratios disclosed for the clays, above.

The clays used as suspending agents for the carbamate softeners are preferably smectite-type clays, since these clays are both excellent suspending aids and provide an additional increment of fabric softness.

Smectite-type clays can be described as impalpable, expandable, three-layer clays, i.e., alumino-silicates and magnesium silicates, having an ion exchange capacity of at least about 50 meg/100 g. of clay. The term "impalpable" as used to describe the clays employed herein means that the individual clay particles are of a size that they cannot be perceived tactilely. Such particle sizes are within the range below about 50 microns. In general, the clays herein will have a particle size within the range of from about 0.5 micron to about 25 microns. The term "expandable" as used to described clays relates to the ability of the layered clay structure to be swollen, or expanded, on contact with water.

There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)_2(OH)_2$, for the aluminum and magnesium oxide type clay, respectively. It is to be recognized that the range of the water of hydration in the clays can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while metal cations such as Na+, Ca++, as well as H+, can be copresent in the water of hydration to provide electrical neutrality. Except as noted hereinafter, such cation substitutions are immaterial to the use of the clays herein since the desirable physical properties of the clays are not substantially altered thereby.

The three-layer, expandable alumino-silicates useful herein are further characterized by a dioctahedral crystal lattice, while the expandable three-layer magnesium silicates have a trioctahedral crystal lattice.

As noted hereinabove, the clays employed in the compositions of the instant invention contain cationic counterions such as protons, sodium ions, potassium ions, calcium ion, magnesium ion, and the like. It is customary to distinguish between clays on the basis of one cation predominantly or exclusively absorbed. For example, a "sodium clay" is one in which the absorbed cation is predominantly sodium. Such absorbed cations can become involved in exchange reactions with cations present in aqueous solutions. A typical exchange reaction involving a smectite-type clay is expressed by the following equation:

$$\text{Smectite clay (Na)} + NH_4OH \rightleftarrows \text{smectite clay } (NH_4) + NaOH.$$

Since in the foregoing equilibrium reaction, one equivalent weight of ammonium ion replaces an equivalent weight of sodium, it is customary to measure clay cation exchange capacity (sometimes termed "base exchange capacity") in terms of milliequivalents per 100 g. of clay (meq/100 g.). The cation exchange capacity of clays can be measured in several ways, including electrodialysis, by exchange with ammonium ion followed by titration, or by a methylene blue procedure, all is fully set forth in Grimshaw, *The Chemistry and Physics of Clays*, Interscience Publishers, Inc. pp. 264–265 (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain clays of the montmorillonite variety. Illite clays have an ion exchange capacity somewhere in the lower portion of the range, i.e., around 26 meq/100 g. for an average illite clay.

Illite and kaolinite clays, have relatively low ion exchange capacities. While these clays can be used as suspending agents herein, they do not provide the additional increment of softness afforded by the smectites. Accordingly, the illite and kaolinite clays are not the preferred clays for use in the instant compositions.

However, smectites, such as nontronite, having an ion exchange capacity of approximately 50 meq/100 g., saponite, which has an ion exchange capacity of around 70 meq/100 g., and montmorillonite, which has an ion exchange capacity greater than 70 meq/100 g., are especially useful in the instant compositions. These clays are excellent suspending agents for the carbamate softeners and, themselves, deposit on the fabrics to provide additional softening benefits. Accordingly, preferred clay minerals useful herein can be characterized as impalpable, expandable, three-layer smectite-type clays having an ion exchange capacity of at least about 50 meq/100 g.

Smectite clays for use in the compositions herein are all commercially available. Such clays include, for example, montmorillonite, volchonskoite, nontronite, American saponite, sauconite, and vermiculite. The clays herein are available under commercial names such as "fooler clay" (clay found in a relatively thin vein above the main bentonite or montmorillonite veins in the Black Hills) and various tradenames such as Thixogel No. 1 (also, "Thixo-Jell") and Gelwhite GP from Georgia Kaolin Co., Elizabeth, New Jersey; Volclay BC and Volclay No. 325, from Americal Colloid Co., Skokie, Illinois; Black Hills Bentonite BH 450, from international Minerals and Chemicals; and Veegum Pro and Veegum F, from R. T. Vanderbilt. It is to be recognized that such smectite-type minerals obtained under the foregoing commercial and tradenames can comprise mixtures of the various discreet mineral entities. Such mixtures of the smectite minerals are suitable for use herein.

While any of the impalpable smectite-type clays having a cation exchange capacity of at least about 50 meq/100 g. are useful herein, certain clays are preferred. For example, Gelwhite GP and "fooler clay" are extremely white forms of smectite clays and are therefore preferred when formulating white, granular compositions or liquid suspensions.

Volclay BC, which is a smectite-type clay mineral containing at least 3% of iron (expressed as $Fe_2O_3$) in the crystal lattice, and which has a very high ion exchange capacity, is one of the most efficient and effective clays for use in laundry compositions and is preferred from the standpoint of fabric softening performance. Likewise, Thixogel No. 1, is a preferred clay herein from the standpoint of through-the-wash fabric softening performance.

As noted hereinabove, the carbamate softener compounds are compatible with anionic detersive surfactants and can be used in combination therewith in combined softener/detergent compositions and baths. Typical compositions of this type comprise from about 2% to 99.5%, preferably 4% to 60%, of a water-soluble anionic surfactant and from about 0.1% to about 50%, preferably 5% to 10%, of the carbamate softener. Preferred compositions will contain from about 0.1% to 10%, preferably 1% to 5% by weight of a clay suspending agent, most preferably a smectite clay of the type disclosed above.

The anionic surfactant of the instant compositions can be a water-soluble organic sulfuric reaction product having in its molecular structure an alkyl group containing from about 8 to about 22 carbon atoms and a sulfonic acid or sulfuric acid ester group, or mixtures thereof. (Included in the term "alkyl" is the alkyl portion of acyl groups.) Examples of this group is synthetic detersive surfactants which can be used in the present invention are the alkyl sulfates, especially those obtained by sulfating the higher alcohols ($C_8$-$C_{18}$ carbon atoms) produced from the glycerides of tallow or coconut oil; and alkyl benzene sulfonates in which the alkyl group contains from about 9 to about 14 carbon atoms in straight chain or branched chain configuration, e.g., those of the type described in U.S. Pat. Nos. 2,220,099 and 2,477,383, incorporated herein by reference. Linear straight chain alkyl benzene sulfonates in which the average of the alkyl groups is about 13 carbon atoms, abbreviated as $C_{13}$LAS, as well as mixed $C_{11.2}$ and $C_{11.8}$ (avg.) LAS are typically used. $C_{11}$-$C_{14}$ branched chain alkyl benzene sulfonates (ABS), which are excellent sudsers, can also be used. The anionics are used in their water-soluble salt form, e.g. as alkali metal salts such as sodium or potassium, or ammonium, or alkanolammonium (such as monoethanolammonium, diethanolammonium or triethanolammonium) salts.

Examples of commercially available alkyl benzene sulfonates (free acid form) useful in the instant invention include Conoca SA 515, SA 597, and SA 697, all marketed by the Continental Oil Company, and Calsoft LAS 99, marketed by the Pilot Chemical Company. These are neutralized prior to use.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of $\alpha$-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms are useful anionic surfactants in the present compositions. Particularly useful are the soaps derivable from the mixtures of fatty acids made from coconut oil and tallow.

Preferred water-soluble anionic organic surfactants herein include linear alkyl benzene sulfonates containing from about 10 to about 18 carbon atoms in the alkyl group; branched alkyl benzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; olefin sulfonates containing from about 14 to 16 carbon atoms; and soaps, as hereinabove defined.

Specific preferred anionics for use herein include: the linear $C_{10}$-$C_{14}$ alkyl benzene sulfonates (LAS); the branched $C_{10}$ to $C_{14}$ alkyl benzene sulfonates (ABS); the tallow alkyl sulfates; the coconut alkyl glyceryl ether sulfonates; the sulfated condensation products of mixed $C_{10}$-$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain non-interfering components which are processing by-products. For example, commercial $C_{10}$-$C_{14}$ alkaryl sulfonates can comprise alkyl benzene sulfonates, alkyl toluene sulfonates, alkyl naphthalene sulfonates and alkyl poly-benzenoid sulfonates. Such materials and mixtures thereof are fully contemplated for use herein.

The compositions herein can optionally employ nonionic detersive surfactants, especially in combination with the anionic surfactants disclosed hereinabove. The presence of the nonionic surfactant promotes oily stain removal from fabrics in combined softener/detergent and presoak compositions.

Nonionic surfactants for use herein comprise the typical nonionic surface active agents well known in the detergency arts. Such materials can be succinctly described as the condensation products of an alkylene oxide (hydrophilic in nature), especially ethylene oxide $(EO)_x$, with an organic hydrophobic compound, which is usually aliphatic or alkyl aromatic in nature. The degree of ethoxylation, which can be an average value in commercial nonionic surfactants, is designated by the subscript, $x$.

The nonionic detersive surfactants for use herein can be prepared by a variety of methods well known in the art. In general terms, such nonionic surfactants are typically prepared by condensing ethylene oxide with an —OH containing hydrocarbyl moiety, e.g., an alcohol or alkyl phenol, under conditions of acidic or basic catalysis.

Non-limiting types of suitable water-soluble nonionic surfactants include the following: the ethylene oxide condensates of $C_6$-$C_{12}$ alkyl phenols; the condensation products of aliphatic alcohols with ethylene oxide (the alkyl chain of the primary, secondary or tertiary aliphatic alcohol can be either straight or branched, and generally contains from about 8 to about 22, preferably 9 to 16, carbon atoms); the condensation products of ethylene oxide with a hydrophobic base formed by the condensation of propylene oxide with propylene glycol; and the condensation products of ethylene oxide with the product resulting from the reaction of propylene oxide and ethylenediamine.

Typical examples of nonionic surfactants used herein include tallowalkyl $(EO)_{10\text{-}22}$, coconutalkyl $(EO)_{10\text{-}20}$, and $C_6$-$C_9$ alkylphenol $(EO)_{6\text{-}20}$.

Compositions and processes employing the carbamate softeners optionally employ various other adjunct surfactants which can be used to perform specific cleaning, suds modifying, etc., functions. Such optional surfactants include the various semi-polar, ampholytic, and zwitterionic surface active agents known in the art. Non-limiting examples of such materials are as follows.

Semi-polar surfactants useful herein include water-soluble amine oxides containing one alkyl moiety of from about 10 to 28 carbon atoms and two moieties selected from the group consisting of alkyl moieties and hydroxyalkyl moieties containing from 1 to about 3 carbon atoms; water-soluble phosphine oxides containing one alkyl moiety of about 10 to 28 carbon atoms and two moieties selected from the group consisting of alkyl moieties and hydroxyalkyl moieties containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms, and at least one aliphatic substituent contains an anionic water-solubilizing group.

Zwitterionic surfactants include derivatives of aliphatic quaternary ammonium, phosphonium and sulfonium compound in which the aliphatic moieties can be straight or branched chain, and wherein one of the aliphatic substituents contains from about 8 to 18 carbon atoms and one contains an anionic water solubilizing group.

The foregoing surfactant types are well known in the detergency arts.

It is to be recognized that any of the foregoing detergents can be used separately or as mixtures.

The foregoing compositions can be prepared and used as free flowing granules or powders, pressed into pellets for easy dispensing, or provided as liquids using liquid carriers of the type disclosed hereinafter.

Detergency builders can be advantageously employed in the combined softener/detergent and presoak compositions herein. Such builders can be employed in concentrations of from about 5% to about 50%, preferably from about 10% to about 35%, by weight of the compositions. The builders suitable for use herein include any of the conventional inorganic and organic water-soluble builder salts well known in the detergency arts.

Examples of seeded builders which are disclosed in Belgian patent 798,856 (1973) of Jacobson, Uchtman, Benjamin and Saylor, incorporated herein by reference, are also suitable for use herein.

Such builders include, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, pyrophosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Examples of these and other phosphorus builder compounds are disclosed in U.S. Pat. Nos. 3,159,581, 3,213,030, 3,422,021, 3,422,137, 3,400,176 and 3,400,148, incorporated herein by reference.

Non-phosphorus containing sequestrants can also be selected for use herein as auxiliary builders.

Specific examples of optional non-phosphorus, inorganic detergent builder ingredients include water-soluble inorganic carbonate, bicarbonate, and silicate salts. The alkali metal, e.g., sodium and potassium, carbonates, bicarbonates, and silicates are particularly useful herein.

Water-soluble, organic non-phosphorus builders are also useful herein. For example, the alkali metal, ammonium and substituted ammonium polyacetates, carboxylates, polycarboxylates and polyhydroxysulfonates are useful auxiliary builders in the present compositions. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid.

Highly preferred non-phosphorus auxiliary builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred auxiliary builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, methylenemalonic acid, 1,1,2,2-ethane tetracarboxylic acid, dihydroxy tartaric acid and ketomalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Impalpable, water-insoluble zeolites, especially hydrated Zeolite A-type materials, are especially useful builders herein. Mixtures of zeolites and auxiliary water-soluble builders are especially useful. Such auxiliary builder salts include alkali metal pyrophosphates, used at a weight ratio of zeolite material to pyrophosphate in the range from about 1:3 to about 3:1; alkali metal salts of sodium tripolyphosphates and nitrilotriacetic acid, used at a weight ratio of zeolite material to auxiliary builder salt in the range from about 1:1 to about 1:3; and alkali metal citrates, used at a weight ratio of zeolite material to citrate in the range of 1:3 to 3:1. It is understood that in the above preferred ranges of auxiliary builder to aluminosilicate the builder component can be represented by mixtures of said builders.

The detergent and/or pre-soak compositions herein can contain all manner of additional materials commonly found in laundering and cleaning compositions. For example, such compositions can contain thickeners and soil suspending agents such as carboxymethylcellulose and the like. (The carboxymethylcellulosics and other, like, soil suspending agents also help suspend the carbamate softeners herein in an aqueous bath.) Various perfumes, optical bleaches, fillers, anti-caking agents, fabric softeners and the like can be present in the compositions to provide the usual benefits occasioned by the use of such materials in detergent compositions. It is to be recognized that all such adjuvant materials are useful herein inasmuch as they are compatible and stable in the presence of the alkyl ammonium carbamates.

The granular compositions herein can also advantageously contain a peroxy bleaching component in an amount from about 3% to about 40%, preferably from about 8% to about 33%, by weight. Examples of suitable peroxy bleach components for use herein include water-soluble perborates, persulfates, persilicates, perphosphates, percarbonates and the like.

Liquid softening and/or combined softening-detergent compositions of the instant invention comprise a liquid carrier selected from the group consisting of water and mixtures of water and water-soluble solvents. Such carriers are used to the extent of from about 50% to 98% of the total liquid compositions. In highly preferred liquid compositions the carrier comprises from about 60%–90% by weight of the total.

Water and alcohol-water mixtures are the preferred carriers for use in the present compositions. When an alcohol-water mixture is employed as a carrier, the weight ratio of water to alcohol preferably is maintained above about 2:1, more preferably from about 3:1 to about 10:1. Higher alcohol (particularly ethanol) concentrations in the water-alcohol mixtures used as carriers herein are preferably avoided because of flammability problems which may arise at such higher alcohol levels.

Any alcohol containing from 1 to about 5 carbon atoms can be employed in the water-alcohol carrier used to prepare the liquid detergent compositions of the present type. Examples of operable alcohols include methanol, ethanol, propanol, isopropanol, butanol, isobutanol, and pentanol; isopropanol and ethanol are highly preferred for general use.

Various liquid or low-melting, water-soluble polyols can also be used as the liquid carriers herein. Such materials include, for example, polyethylene glycol, especially the ethylene glycols in the molecular weight range of 500–1500; the polyethoxylated poly-ols commercially available as Carbitol; glycerines and polymers thereof; and the like.

Other water-soluble solvents which can be used herein in a manner similar to the alcohols include:

ketones such as acetone; aldehydes such as propionaldehyde; ethers such as diethyl ether, and the like; as well as various natural water-soluble oils which contain such water-soluble organic solvents.

Granular or powdered softening/detergent compositions can be prepared by any of the several well-known procedures for preparing solid commercial detergent compositions. For example, the compositions can be prepared by simply admixing the dry alkyl ammonium carbamate with the desired water-soluble organic detergent compound. The adjuvant builder materials and optional ingredients are admixed therewith, as desired. Alternatively, an aqueous slurry of the alkyl ammonium carbamate containing the dissolved, water-soluble organic detergent compound and the optional and auxiliary materials can be spray-dried in a tower to provide a granular composition. The granules of such spray-dried detergent compositions comprise a uniform mixture of the alkyl ammonium carbamate, the organic detergent compound and the optional and auxiliary materials.

The alkyl ammonium carbamate compounds do not interfere with sudsing or fabric cleansing. Compositions containing the alkyl ammonium carbamate, clay, cationic or anionic detergent, detergency builders and other additives, all as described hereinabove, have the advantage of being a unitary product which the user can place into the washing bath without having to interrupt the cycle at any other stage to add a fabric softener.

Powdered compositions comprising the alkyl ammonium carbamate can be formulated for an enzyme-active laundry pre-soaking or deterging process. Such compositions will contain from about 0.01% to 3% of a proteolytic or lipolytic enzyme of the type commonly used in detergent compositions.

The alkyl ammonium carbamate softening agent herein can also be delivered to fabric surfaces in a clothes dryer simply by placing a measured amount in the dryer, for example, as a foam, solution, dispersion, or by simply sprinkling it over the fabrics. In a typical use situation, from about 1 gram to about 10 grams of the carbamate is uniformly delivered to damp fabrics (i.e., containing ca. 50%–100% their weight of water) which have been freshly laundered, rinsed and spun-dry. The fabrics are dried, with heat (ca. 57°C–100°C), in an automatic dryer and are concurrently softened by the carbamate.

In a preferred embodiment for dryer application, a pre-selected amount of the carbamate softener is provided as an article of manufacture in combination with a dispensing means which uniformly releases the softener with the tumbling action of the dryer. Such dispensing means can be designed for single use or for multiple usage.

One such article for dryer use comprises a pouch releasably enclosing enough of an aqueous suspension of the softener to treat an average 5–10 lbs. (dry weight) load of fabrics. An article of this type can be made by filling a hollow, open pore polyurethane sponge pouch with about 15–20 grams of an aqueous softener composition of the type described for use in the aqueous washing or rinsing bath. In use, the tumbling of the dryer causes the composition to pass through the pores of the sponge and onto the fabrics.

Another article comprises a perforated plastic bag releasably enclosing a fluid gel composition made from the liquid softener composition. The tumbling action of the dryer dispenses the composition to provide softening of the fabrics.

Yet another article comprises an open pore polyurethane sponge pouch containing 1–10 grams of the carbamate softener which is released as a dry powder onto the damp fabrics.

Sheets of paper or woven or non-woven cloth can be inpregnated or coated with the carbamate softener (1–10 grams per sheet) and used in a dryer. The sheets have the advantage that they can be conveniently packaged in roll form.

As can be seen from the foregoing, the present invention encompasses fabric softening and anti-static compositions comprising a softening amount of the alkyl ammonium carbamate compound and sufficient impalpable clay, especially smectite clay, most preferably white smectite clay, to suspend said alkyl ammonium carbamate in water so that uniform deposition onto fabrics will occur. Most preferably, the alkyl ammonium carbamate is of sufficiently small particle size to be impalpable. Typical compositions of this type will comprise from about 1% to about 20%, more preferably 5% to 10% (i.e., the "softening amount") of the carbamate compound and from about 0.1% to about 10%, more preferably 1% to 5% (i.e., the amount sufficient to suspend the carbamate in water) of the clay or other suspending agent.

Compositions of this type are suitable for use in presoak baths, laundering baths or rinse baths.

Liquid compositions herein comprise a softening amount, i.e., from about 1% to about 20%, more preferably 5% to 10%, of the alkyl ammonium carbamate and from about 75% to about 99%, more preferably 80% to 90% by weight of a liquid carrier of the type described hereinabove. Such compositions also preferably contain from about 0.1% to about 10%, more preferably 1% to 5%, of the clay or other suspending agent. Again, white smectite clays are preferred for use in such liquid compositions.

Combined fabric softening and detergent compositions comprise a softening amount of the alkyl ammonium carbamate, i.e., from about 0.1% to about 50%, more preferably 5% to about 10%, and a detersive amount of a water-soluble detersive surfactant compound, i.e., from about 2% to about 99.5%, more preferably 4% to about 60% of the total composition. Preferred combined fabric softening and detergent compositions comprise, as an additional component, sufficient impalpable clay to suspend the alkyl ammonium carbamate softener in water. Such compositions will comprise from about 0.1% to about 10%, more preferably 1% to 5% of the clay additive, especially impalpable, white smectite clay.

Highly preferred combined softening and detergent compositions herein also comprise, as an additional component, from about 5% to 75%, more preferably 10% to 60% of a detergency builder. Such builders are selected from the group consisting of water-soluble phosphate builders, water-soluble non-phosphate builders, water-insoluble zeolite builders, and mixtures thereof, all as described in great detail hereinabove. Such built compositions also desirably contain a clay, especially an impalpable smectite clay, or other suspending agent, in the amount set forth hereinabove.

Highly preferred detergent compositions herein comprise the alkyl ammonium carbamate in combination with a surfactant compound which is a member selected from the group consisting of the following detersive surfactants: alkyl benzene sulfonates; tallowalkyl sulfates; coconutalkyl glyceryl sulfonates; alkyl ether (ethoxylated) sulfates; olefin sulfonates; and soaps.

The dryer-added fabric softening articles herein comprise a fabric softening amount, i.e., from about 1 gram to about 15 grams, more preferably from about 5 grams to about 10 grams, of the alkyl ammonium carbamate softener held in releasable combination with a dispensing means. Highly preferred articles of this type are those wherein the dispensing means is a sheet of paper or sheet of woven or non-woven cloth. Such sheet dispensing means are more fully described in U.S. Pat. No. 3,686,025, Morton, TEXTILE SOFTENING AGENTS IMPREGNATED INTO ABSORBENT MATERIALS, issued Aug. 22, 1972, the disclosures of which are incorporated herein by reference. U.S. Pat. No. 3,414,459, Wells, COMPRESSIBLE LAMINATED PAPER STRUCTURE, issued Dec. 3, 1968, the disclosures of which are incorporated herein by reference, describes a preferred paper substrate for use in the dryer-added articles herein.

As described in detail hereinabove, the alkyl ammonium carbamate softeners and anti-static ingredients for use herein are characterized by at least one long chain alkyl group having 10 or more carbon atoms. It will be appreciated that there are a great variety of such carbamate materials readily available by the reaction of carbon dioxide with any desired long chain amine. It will also be appreciated that the alkyl groups in the amine used to prepare the carbamate softeners herein can be substituted with groups such as esters, alcohols, ketones, aldehydes, halogens, amines, and the like. Likewise, the alkyl groups present on the carbamates can be unsaturated, or poly-unsaturated. Likewise, the alkyl groups can be cyclic in configuration or can be highly branched. Inasmuch as the softening effect of the carbamate appears to be the result of a simple sorption onto the fabric surface and the establishment thereon of a "long greasy tail," the presence or absence of substituent groups which do not interfere with this mechanism is of no consequence to the functioning of the compositions and articles herein and can be left to the desires of the formulator.

Preferred carbamate compounds herein by virtue of their relatively low cost, easy availability and excellent softening performance are N,N'-dioctadecyl ammonium carbamate, N,N'-ditallowalkyl ammonium carbamate and N,N'-dicoconutalkyl ammonium carbamate.

The following examples illustrate the present invention and its practice, but are not intended to be limiting thereof.

EXAMPLE I

A solid, washer-added softening composition is as follows.

Equal parts of N,N'-dioctadecyl ammonium carbamate (ca. 0.05–10 micron size range) and micron-size Gelwhite GP clay are mixed. This mixture is suitable for use in powder form and can be added directly to a laundry bath along with detergent. The mixture can also be used in a detergent-free rinse bath.

The 1:1 mixture of clay and carbamate, above, is easily pressed into a pellet using a standard pellet press. The pellet disintegrates in water, i.e., during a washing or rinsing process, to release the N,N'-dioctadecyl ammonium carbamate softener.

The composition of Example I (ca. 10 grams) is added to an aqueous laundry bath (ca. 17 gal.) with a commercial, built anionic detergent composition. Fabrics laundered in the bath show increased softness and anti-static properties over fabrics washed in baths containing the detergent alone, in baths containing only detergent and clay, and in baths containing detergent-plus-conventional cationic softeners.

In the composition of Example I the N,N'-dioctadecyl ammonium carbamate is replaced by an equivalent amount of N,N'-ditallowalkyl ammonium carbamate and N,N'-dicoconutalkyl ammonium carbamate, respectively, and excellent softening results are secured, both in the presence and absence of detersive anionic surfactants.

In the composition of Example I the Gelwhite GP is replaced by an equivalent amount of the following 0.1–5 micron size smectite clays, respectively, and excellent fabric softening and anti-static results are secured: saponite, Thixogel No. 1, Veegum Pro, "fooler clay" and hectorite.

In the composition of Example I, the Gelwhite GP is replaced by an equivalent amount of dextran, sodium alginate, ditallowdimethylammonium chloride, alkoxycellulose, and sodium carboxymethylcellulose, respectively as suspending agents for the carbamate softener. Fabrics laundered in the bath show increased softness and anti-static properties over fabrics washed in bath containing detergent alone.

EXAMPLE II

A spray-dried softening/pre-soak composition is as follows.

| Ingredient | % (Wt.) |
|---|---|
| N,N'-dioctadecyl ammonium carbamate | 10.0 |
| Gelwhite GP clay | 10.0 |
| Sodium tripolyphosphate | 20.0 |
| Sodium perborate | 15.0 |
| Borax | 15.0 |
| Tallowalkyl $(EO)_{22\ (avg.)}$ | 3.0 |
| Enzyme* | 0.7 |
| Sodium linear alkyl benzene sulfonate | 2.0 |
| Sodium carbonate | 4.5 |
| Sodium silicate | 4.8 |
| Sodium sulfate | 11.0 |
| Coconut alcohol $(EO)_6$ | 1.0 |
| Minors** | Balance |

*Protease/amylase mixture from *Thermoactinomyces vulgaris* ATCC15734
**Including optical bleach, dye, perfume, etc. and 0.5% water, 0.1% sodium toluene sulfonate hydrotrope.

The composition of Example II is prepared by admixing the ca. 1 micron carbamate and ca. 0.5 micron clay with the other ingredients (exclusive of enzyme) in water and spray-drying in a standard tower. The enzyme is dry-mixed with the resulting granules.

Soiled fabrics are soaked for 1 hour in an aqueous bath containing 0.7% by weight of the composition of Example II. After laundering with a commercial anionic detergent, the fabrics show increased softness and anti-static properties over fabrics treated in a pre-soak bath containing a commercial ditallowalkyl cationic softener.

EXAMPLE III

A liquid softening composition comprising a suspension of a particulate carbamate softener and clay particles in a liquid carrier is as follows.

| Ingredient | % (wt.) |
|---|---|
| N,N'-dioctadecyl ammonium carbamate | 8.3 |
| Gelwhite clay | 1.6 |
| Isopropyl alcohol | 1.6 |
| Water | 88.3 |
| Perfume | 0.2 |

The composition of Example III is prepared by mixing the clay (avg. particle diameter 0.5 micron), the carbamate (avg. particle diameter ca. 1 micron) and the balance of the ingredients in a high speed mixer.

The composition of Example III (2.0 oz.) is added to a 17 gal. rinse bath containing 5.5 lbs. of freshly laundered cotton, polyester and polyester/cotton fabrics. After ca. 4 minutes agitation, the fabrics are spun dry and then dried in an automatic clothes dryer according to manufacturers' instructions. The fabrics are provided with a soft, anti-static finish.

The composition of Example III is applied to freshly cleaned carpets. The carpet is provided with an anti-static finish.

The alkyl ammonium carbamate is sprinkled onto synthetic fabric before processing in a textile mill. Excellent anti-static properties are imparted to the fabric.

What is claimed is:

1. A fabric softening and anti-static composition comprising a softening amount of an alkyl ammonium carbamate compound of the formula $$R_1R_2\overset{+}{N}H\ {}_2\overset{-}{O}\ (O)CNR_3R_4$$

wherein $R_1$ is hydrogen or an alkyl group, $R_2$ is a long chain alkyl group having 10 or more carbon atoms, $R_3$ is hydrogen or an alkyl group, and $R_4$ is hydrogen or an alkyl group; and sufficient suspending agent to suspend said alkyl ammonium carbamate in water.

2. A composition according to claim 1 wherein the alkyl ammonium carbamate is impalpable.

3. A composition according to claim 2 wherein the weight ratio of alkyl ammonium carbamate to suspending agent is in the range from 1:10 to 10:1.

4. A composition according to claim 3 wherein the suspending agent is a clay.

5. A composition according to claim 4 wherein the clay is a white smectite clay.

6. A composition according to claim 5 wherein the weight ratio of alkyl ammonium carbamate:white smectite clay is in the range of 1:4 to 4:1.

7. A composition according to claim 5 wherein the alkyl ammonium carbamate is a member selected from the group consisting of N,N'-dioctadecyl ammonium carbamate, N,N'-ditallowalkyl ammonium carbamate and N,N'-dicoconutalkyl ammonium carbamate.

8. A composition according to claim 3 wherein the suspending agent is a quaternary ammonium compound.

9. A composition according to claim 8 wherein the quaternary ammonium is ditallowdimethylammonium chloride.

10. A composition according to claim 3 wherein the suspending agent is a nonionic, zwitterionic, or anionic surfactant, present in a non-detersive amount.

11. A composition according to claim 3 wherein the suspending agent is a water-soluble organic solvent.

12. A combined fabric softening and detergent composition comprising a softening amount of an alkyl ammonium carbamate compound of the formula $$R_1R_2\overset{+}{N}H\ {}_2\overset{-}{O}\ (O)CNR_3R_4$$

wherein $R_1$ is hydrogen or an alkyl group, $R_2$ is a long chain alkyl group having 10 or more carbon atoms, $R_3$ is hydrogen or an alkyl group, and $R_4$ is hydrogen or an alkyl group; and a detersive amount of a water-soluble detersive surfactant compound.

13. A composition according to claim 12 wherein the surfactant compound is an anionic surfactant.

14. A composition according to claim 13 wherein the anionic surfactant is a member selected from the group consisting of alkyl benzene sulfonates, tallowalkyl sulfates, coconutalkyl glyceryl sulfonates, alkyl ether (ethoxylated) sulfates, olefin sulfonates, and soaps.

15. A composition according to claim 12 which comprises, as an additional component, sufficient suspending agent to suspend the alkyl ammonium carbamate in water.

16. A composition according to claim 15 wherein the suspending agent is an impalpable clay.

17. A composition according to claim 16 wherein the alkyl ammonium carbamate is a member selected from the group consisting of N,N'-dioctadecyl ammonium carbamate, N,N'-ditallowalkyl ammonium carbamate and N,N'-dicoconutalkyl ammonium carbamate, the surfactant compound is a member selected from the group consisting of alkyl benzene sulfonates, tallowalkyl sulfates, coconutalkyl glyceryl sulfonates, alkyl ether (ethoxylated) sulfates, olefin sulfonates, and soaps, and the clay is a smectite clay.

18. A composition according to claim 12 which comprises, as an additional component, from 5% to 75% by weight of a detergency builder.

19. A composition according to claim 18 wherein the builder is a member selected from the group consisting of water-soluble phosphate builders, water-soluble non-phosphate builders, water-insoluble zeolite builders, and mixtures thereof.

20. A composition according to claim 19 which comprises, as an additional component, from 0.1% to 10% by weight of a suspending agent.

21. A dryer-added fabric softener comprising a fabric softening amount of an alkyl ammonium carbamate of the formula $$R_1R_2NH^+{}_2O^-(O)CNR_3R_4$$

wherein $R_1$ is hydrogen or an alkyl group, $R_2$ is a long chain alkyl group having 10 or more carbon atoms, $R_3$ is hydrogen or an alkyl group, and $R_4$ is hydrogen or an alkyl group, in releasable combination with a dispensing means selected from the group consisting of a sheet of paper, or woven or non-woven cloth.

22. An article according to claim 21 wherein the carbamate is a member selected from the group consisting of N,N'-dioctadecyl ammonium carbamate, N,N'-ditallowalkyl ammonium carbamate and N,N'-dicoconutalkyl ammonium carbamate.

* * * * *